United States Patent [19]

Spiegel

[11] 4,387,496

[45] Jun. 14, 1983

[54] METHOD OF FORMING A SPRAY ARM

[75] Inventor: Raymond W. Spiegel, Lincoln Township, Berrien County, Mich.

[73] Assignee: Whirlpool Corporation, Benton Harbor, Mich.

[21] Appl. No.: 214,018

[22] Filed: Dec. 8, 1980

[51] Int. Cl.[3] ..... B23P 11/00; B23P 17/00; B21D 39/02

[52] U.S. Cl. ..... 29/416; 29/509

[58] Field of Search ..... 29/412, 415, 416, 417, 29/509; 113/116 F, 116 G, 116 V, 116 Y, 116 AA, 116 BB, 116 HH, 120 K; 72/379

[56] References Cited

U.S. PATENT DOCUMENTS

| | | | |
|---|---|---|---|
| 280,918 | 7/1883 | Dunn | 148/12.1 |
| 517,523 | 4/1894 | Kleinfeldt | 113/116 V |
| 652,990 | 7/1900 | Wood | 29/416 X |
| 2,168,358 | 8/1939 | Lyon . | |
| 2,905,393 | 9/1959 | Federighi et al. | 239/183 |
| 3,277,906 | 10/1966 | Goldman | 134/57 |
| 3,288,155 | 11/1966 | Swetnam | 134/176 |
| 3,453,715 | 7/1969 | Rogers | 29/416 |

*Primary Examiner*—Ervin M. Combs

*Attorney, Agent, or Firm*—Wood, Dalton, Phillips, Mason & Rowe

[57] ABSTRACT

A dishwasher spray arm having a top wall portion joined to a bottom wall portion. The wall portions are constructed to be formed from identical Z-shaped sheet blanks. The wall portion edges define securing structure which, while being different in the two wall portions, are each preselected to closely fit within the Z-shaped sheet blank configuration. The Z-shaped blanks define a continuing series arranged to be cut from a strip of sheet material with a common edge between successive blanks, effectively minimizing material wastage in the formation of the spray arm. In the illustrated embodiment, the top wall portion defines further structure differing from that of the lower wall portion.

5 Claims, 6 Drawing Figures

FIG. 1
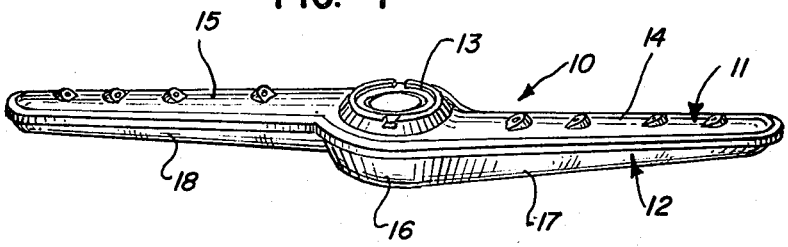
FIG. 2
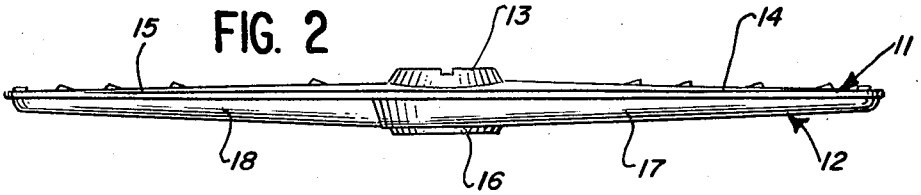
FIG. 3
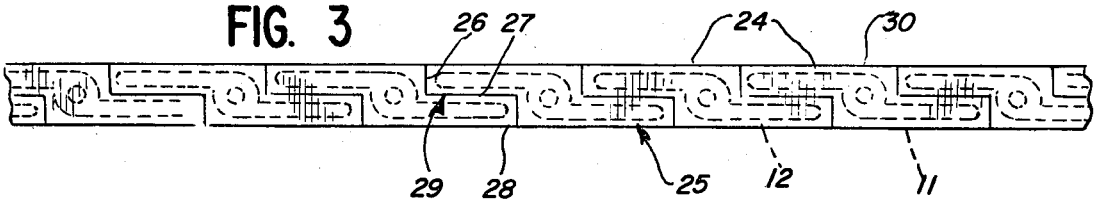
FIG. 4
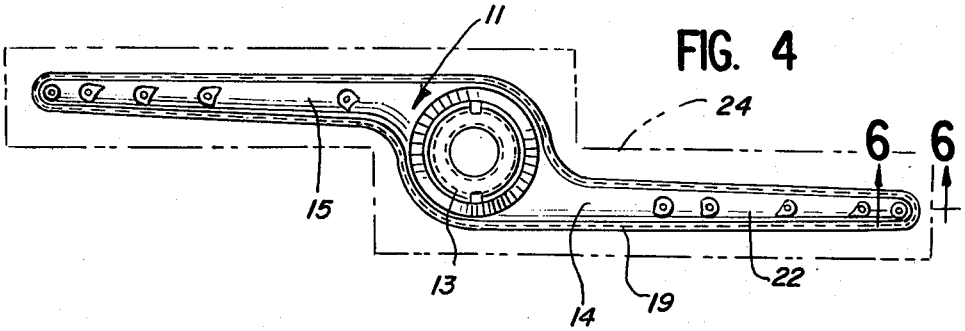
FIG. 5
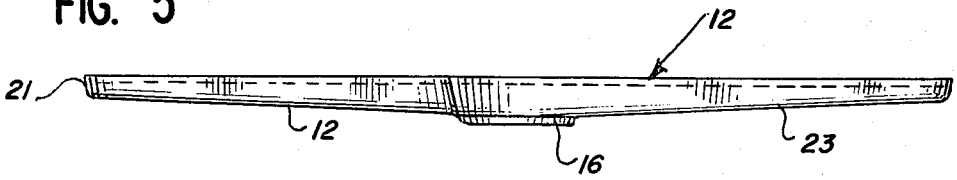
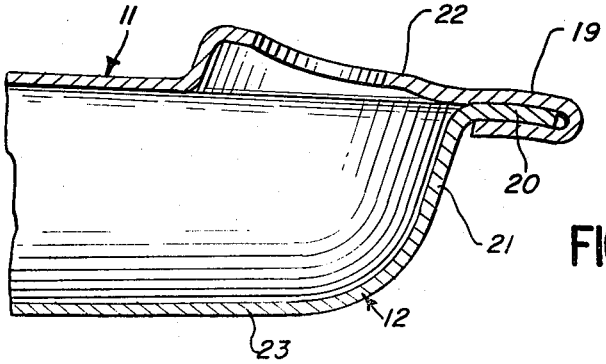
FIG. 6

METHOD OF FORMING A SPRAY ARM

BACKGROUND OF THE INVENTION

1. Field of the Invention

This invention relates to spray arms and in particular to the manufacture of hollow spray arms from sheet material.

2. Description of the Prior Art

In dishwashers and the like, it has been conventional to provide rotating spray arms for throwing the cleaning liquid in spray jets throughout the space in which the articles to be cleaned are disposed. The spray arms define hollow elements through which the liquid is passed from a suitable impeller. The arms are provided with suitable spray outlets through which the liquid is caused to pass under pressure in the form of spray jets. A number of different configurations for such spray arms have been developed in the art. For example, a spray arm for such use is illustrated in U.S. Pat. No. 2,905,393 of George J. Fedrighi et al. As shown therein, the spray arm is defined by an upper wall and a lower wall cooperatively defining a hollow space through which the washing liquid is passed to the outlet spray openings.

Another form of such a washing system spray arm is illustrated in U.S. Pat. No. 3,288,155 of Norman T. Swetnam.

One method of forming such spray arms has been to form the top and bottom wall thereof from sheet stock, such as sheet metal stock. It has been conventional to stamp elements from sheet stock for further forming operations in forming a number of different devices. Illustratively, in U.S. Pat. No. 1,889,037, William Clarke S. Mays shows the stamping of blanks from a sheet for subsequent formation of writing instrument clips from the blanks. As shown in that patent, the clip blanks are cut from the strips with lace material being left between the respective clip blanks.

George A. Lyon shows, in U.S. Pat. No. 2,168,358, a method of forming an impact member wherein successive blanks are cut from a strip with only a small portion of the blanks being wasted in forming the series of identical impact members.

Where the final formed objects are identical, it has been possible to utilize the entire sheet material without wastage. Thus, as shown in U.S. Pat. No. 1,576,304, of John E. Bryers, implement sockets having a preselected configuration are cut from the stock strip with each portion cut from the strip being formed into an implement socket without further removal of material therefrom.

Similarly, in U.S. Pat. No. 1,819,142, James H. Wily shows a handle connector having blank portions in nested association so as to provide the desired connector structure without wastage from the supply strip.

Stanley B. Elliott shows, in U.S. Pat. No. 3,852,870, a method of producing ornamental articles having a configuration illustrated in FIG. 10 of that patent from blanks cut continuously from a strip without scrap loss in the formation process.

Fred E. Ahlbin discloses in German Pat. No. 1,452,549, published Apr. 3, 1969, a method of manufacturing scissors wherein the two halves of the scissors are formed from a blank cut from a sheet.

SUMMARY OF THE INVENTION

The present invention comprehends an improved hollow spray arm for use such as in a dishwasher wherein the top and bottom wall portions of the spray arm are formed from identical Z-shaped sheet blanks notwithstanding the provision of edge portions of the top and bottom wall portions having different configurations.

The edge portions define securing means for securing the top and bottom wall in association to define the desired hollow spray arm structure.

In the illustrated embodiment, the top wall edge portion defines an area greater than that defined by the edge portion of the bottom wall.

The invention comprehends the formation of the spray arm by a process including the steps of providing a strip of sheet material from which the spray arm is to be formed, dividing the strip successively at longitudinally spaced positions to define a series of identical blanks each having a central portion extending the full width of the strip and oppositely extending end portions, one end portion extending from one side of the strip substantially one-half the width of the strip and the other end portion extending from the opposite side of the strip substantially one-half the width of the strip, the blanks having a configuration preselected to permit formation of either of the different wall configurations with effectively minimum total wastage, forming the top wall from one of the blanks, forming the bottom wall from the other of the blanks, and securing the top and bottom walls edgewise to form the hollow spray arm.

The wall portion edges may be crimped together in securing the top wall portion to the bottom wall portion.

In the illustrated embodiment, the Z-shaped blanks are defined by a plurality of rectilinear separation lines which define common edges between successive blanks cut from the supply strip.

BRIEF DESCRIPTION OF THE DRAWING

Other features and advantages of the invention will be apparent from the following description taken in connection with the accompanying drawing wherein:

FIG. 1 is a perspective view of a spray arm embodying the invention;

FIG. 2 is a side elevation thereof;

FIG. 3 is a fragmentary plan view of a supply strip illustrating the cutting thereof into successive Z-shaped blanks to be formed into the top and bottom wall portions of the spray arm respectively;

FIG. 4 is a top plan view of the spray arm showing the Z-shaped blank configuration in broken lines thereabout;

FIG. 5 is a side elevation of the bottom wall portion of the spray arm prior to the assembly thereof with the top wall portion; and FIG. 6 is a fragmentary enlarged vertical section taken substantially along the line 6—6 of FIG. 4 and illustrating in greater detail the securing of the edge of the top wall portion to the edge of the bottom wall portion in forming the hollow spray arm.

DESCRIPTION OF THE PREFERRED EMBODIMENT

In the exemplary embodiment of the invention as disclosed in the drawings, and particularly FIG. 1, a spray arm generally designated 10 is shown to comprise a dishwasher spray arm having a top wall portion 11 and a bottom wall portion 12. The top wall portion defines a hub 13, a first outwardly extending leg 14, and a second oppositely outwardly extending leg 15. The bottom wall portion defines a hub 16, a first outwardly extending leg 17, and a second oppositely outwardly extending leg 18.

Top wall portion 11, as shown in FIGS. 1 and 2, has a configuration differing from that of the bottom wall portion 12. More specifically, as illustrated best in FIG. 6, an edge 19 of top wall 11 has a configuration differing from the configuration of an edge 20 of bottom wall 12. As shown in FIG. 6, the edges 19 and 20 are mechanically interlocked as by crimping the edge 19 about the edge 20 after turning the edge 20 from an upright end wall 21 of the bottom portion 12. As further shown in FIG. 6, a midportion 22 of the top wall differs in detail from a midportion 23 of bottom wall 12 in further defining the structural differences between top wall 11 and bottom wall 12.

As indicated briefly above, the invention comprehends the formation of spray arm 10 at minimum cost by forming the upper and lower wall portions 11 and 12 with minimum wastage. As shown in FIG. 3, a plurality of Z-shaped blanks 24 are separated from a sheet strip 25, such as stainless steel, as by conventional cutting operations, along separating lines defined by rectilinear portions 26, 27 and 28. Thus, the separating line effectively defines a Z-line 29 which is repeated seriatim at spaced intervals along the longitudinal extent of strip 25 so as to define successive Z-shaped blanks 24 having a Z-line 29 common to the successive blanks 24.

As further shown in FIG. 3, a top wall portion 11 may be formed from one of the blanks 24 and a bottom wall portion 12 may be formed from another of the blanks 24, with each of the wall portions defining the peripheral edge thereof having a configuration preselected to closely fit within the Z-shaped blank, notwithstanding the provision of identical blanks for each of the differently configured top and bottom wall portions.

As shown in FIG. 5, an end wall 21 of bottom portion 12 may be originally formed to extend upwardly, permitting the edge 20 to be formed outwardly from the upwardly extending disposition during the securing operation, as illustrated in FIG. 6.

Thus, the invention broadly comprehends the provision, in a dishwasher spray arm having top and bottom wall portions formed from sheet blanks 24, of means on the edge 19 of the top wall portion defining first securing means having a configuration preselected to closely fit within the Z-shaped blank 24, and means on the edge 20 of the bottom wall portion defining second securing means differing from the securing means 19 and constructed to cooperate with the securing means 19 in securing the edges of the top and bottom wall portions together in defining the hollow spray arm 10, with the edge securing means 20 on the bottom wall portion having a configuration also preselected to closely fit within a Z-shaped sheet blank identical to the sheet blank from which the top wall portion is formed, notwithstanding the different structure of the formed wall portions.

Further resultingly, the invention comprehends the improved method of forming such a hollow spray arm, including the steps of providing a strip of sheet material 25, dividing the strip successively at longitudinally spaced positions along lines 29 to define a series of identical Z-shaped blanks each having a central portion 30 extending the full width of the strip and oppositely extending legs, such as legs 14, 15, 17 and 18, having a width substantially one-half that of the strip. The blanks have a configuration preselected to permit formation of either of the different wall configurations, each with effectively minimum total wastage. The top wall is formed from one of the identical blanks and the bottom wall is formed from another of the identical blanks, with the edges of the top and bottom walls so formed securing the walls in a hollow spray arm assembled configuration.

The foregoing disclosure of specific embodiments is illustrative of the broad inventive concepts comprehended by the invention.

I claim:

1. The method of forming a hollow dishwasher spray arm having a top wall defining a first formed configuration and a bottom wall defining a second, substantially different formed configuration, comprising the steps of:

providing a strip of sheet material from which the spray arm is to be formed;

dividing the strip successively at longitudinally spaced portions to define a series of blanks, each blank having a central portion extending the full width of the strip and oppositely extending end portions, one end portion extending from one side of the strip substantially one-half the width of the strip and the other end portion extending from the opposite side of the strip substantially one-half the width of the strip, the substantially different configurations of the spray arm top and bottom walls and the configuration of said blanks from which they are to be formed being coordinated such that each of said blanks is identical and suitable for use in forming either of said spray arm top or bottom walls with effectively minimized wastage;

forming said top wall from one of said blanks;

forming said substantially different bottom wall from the other of said blanks; and securing the top and bottom walls edgewise to form the hollow spray arm.

2. The method of claim 1 wherein said blanks are stamped from said strip in said dividing step.

3. The method of claim 1 wherein the edges of said top and bottom walls are crimped together in said securing step.

4. The method of claim 1 wherein said strip is formed of stainless steel.

5. The method of claim 1 wherein the blanks are divided from the strip by a plurality of rectilinear separation lines.

* * * * *